US010897954B2

(12) United States Patent
Knutson

(10) Patent No.: US 10,897,954 B2
(45) Date of Patent: Jan. 26, 2021

(54) SHOE COVER SYSTEM AND METHOD OF USE

(71) Applicant: Steve Knutson, Byron, MN (US)

(72) Inventor: Steve Knutson, Byron, MN (US)

( * ) Notice: Subject to any disclaimer, the term of this patent is extended or adjusted under 35 U.S.C. 154(b) by 417 days.

(21) Appl. No.: 14/584,669

(22) Filed: Dec. 29, 2014

(65) Prior Publication Data

US 2015/0196093 A1 Jul. 16, 2015

Related U.S. Application Data

(60) Provisional application No. 61/928,322, filed on Jan. 16, 2014.

(51) Int. Cl.

| | |
|---|---|
| ***A43B 3/16*** | (2006.01) |
| ***A43B 7/02*** | (2006.01) |
| ***A43B 3/00*** | (2006.01) |
| ***A43B 7/12*** | (2006.01) |
| ***A43B 7/34*** | (2006.01) |
| ***A43B 1/00*** | (2006.01) |
| ***A43B 3/24*** | (2006.01) |

(52) U.S. Cl.

CPC ..... *A43B 7/02* (2013.01); *A43B 1/0081* (2013.01); *A43B 3/0031* (2013.01); *A43B 3/16* (2013.01); *A43B 3/166* (2013.01); *A43B 3/24* (2013.01); *A43B 7/12* (2013.01); *A43B 7/34* (2013.01)

(58) Field of Classification Search

CPC ..... A43B 7/12; A43B 7/02; A43B 1/0081; A43B 3/166; A43B 3/163; A43B 3/18; A43B 3/0031; A43B 23/227; A43B 3/16; A43B 3/24; A63C 3/00; A41D 17/00

USPC ..... 36/2 R, 163, 100, 7.1 R, 1.5, 58.5, 72 R; 602/3, 30; 2/22, 60, 139, 911

See application file for complete search history.

(56) References Cited

U.S. PATENT DOCUMENTS

| | | | | | |
|---|---|---|---|---|---|
| 1,463,531 | A | * | 7/1923 | Kennedy | A43C 11/24 36/34 R |
| 1,708,144 | A | * | 4/1929 | Martin | A41D 17/00 2/61 |
| 1,832,866 | A | * | 11/1931 | Johnson | A63C 3/00 280/811 |
| 2,029,787 | A | * | 2/1936 | Ohler | A43B 5/18 280/811 |
| 2,068,946 | A | * | 1/1937 | Ferguson | A43B 23/20 36/1 |
| 2,587,205 | A | * | 2/1952 | Paster | A63C 3/00 2/245 |

(Continued)

OTHER PUBLICATIONS

"Portion" The Free Dictionary by Farlex. Web. https://www.thefreedictionary.com/portion, Aug. 2019.*

(Continued)

*Primary Examiner* — Jillian K Pierorazio

(74) *Attorney, Agent, or Firm* — Merchant & Gould P.C.

(57) ABSTRACT

A cover for athletic shoes, namely running shoes which provide protection from the elements such as rain, sleet, snow and cold temperatures. The cover should be non-obtrusive, not substantially detract from the aesthetics of the underlying shoe chosen by the wearer, while also being durable and inexpensive to manufacture. The cover should also not reduce the overall performance of the sole. The covers are lightweight, tuck easily into a small pocket, and quickly removable for ease of use.

19 Claims, 9 Drawing Sheets

(56) References Cited

U.S. PATENT DOCUMENTS 2,615,261 A * 10/1952 La Grotto ..... A43C 13/14 33/18.3
2,836,908 A * 6/1958 Altinger ..... A43B 5/1683 280/811
2,887,795 A * 5/1959 Taicher ..... A43C 11/24 36/1
2,984,917 A * 5/1961 Saunders ..... A43B 5/18 280/811
3,032,896 A * 5/1962 Weaver ..... A43B 1/0027 36/101
3,040,455 A * 6/1962 Criswell ..... A43C 13/14 36/72 R
3,271,888 A * 9/1966 Graham ..... A43C 13/14 36/72 R
3,672,077 A 6/1972 Coles
3,994,080 A * 11/1976 Flanagan, Jr. ..... A43B 1/0027 36/100
4,201,395 A * 5/1980 Matejec ..... A43B 5/1666 280/811
4,237,628 A * 12/1980 Etancelin ..... A43B 5/14 36/131
4,259,791 A * 4/1981 Bazan ..... A43B 5/18 36/117.2
4,333,248 A * 6/1982 Samuels ..... A43B 3/18 36/101
4,503,566 A * 3/1985 Wheeler ..... A41D 17/00 2/22
4,597,199 A * 7/1986 Hong ..... A43B 7/32 36/114
4,604,816 A * 8/1986 Davison ..... A43B 5/18 36/1.5
4,665,633 A * 5/1987 Edgerton ..... A43B 3/16 36/2 R
4,845,864 A * 7/1989 Corliss ..... A43B 5/14 36/131
4,896,437 A * 1/1990 Johnson ..... A43B 23/06 2/22
4,967,493 A * 11/1990 Mues ..... A43C 13/14 36/126
4,991,318 A * 2/1991 Cornell ..... A43B 3/20 36/72 R
5,165,182 A * 11/1992 Michael ..... A43B 3/16 36/1.5
5,168,644 A * 12/1992 Ellis ..... A43B 5/145 36/131
5,251,386 A * 10/1993 Diaz ..... A41D 17/00 36/1.5
5,307,569 A * 5/1994 Melcher ..... A43D 999/00 36/50.1
5,544,430 A * 8/1996 Jacko ..... A43B 3/16 36/100
5,566,477 A * 10/1996 Mathis ..... A43B 3/0078 36/100
5,570,523 A * 11/1996 Lin ..... A43B 3/26 36/100
5,701,688 A * 12/1997 Crowley ..... A43B 23/26 36/101
D389,989 S * 2/1998 Pilz ..... D2/909
5,845,416 A * 12/1998 Hands ..... A43B 3/16 36/2 R
5,855,078 A * 1/1999 Starker ..... A43B 5/145 36/131
6,212,797 B1 * 4/2001 Merry ..... A43B 3/24 36/101
6,243,973 B1 6/2001 Lind
D450,175 S * 11/2001 Lofley ..... D2/909
6,408,542 B1 * 6/2002 Shepherd ..... A43B 5/00 36/114
6,457,260 B1 * 10/2002 Roelofs ..... A41D 17/00 2/23
6,475,051 B1 * 11/2002 Griffin ..... A43B 3/16 36/112
D482,514 S * 11/2003 Whittington ..... D2/909
6,651,360 B1 11/2003 Lind
6,662,476 B1 12/2003 Lind
6,898,873 B2 5/2005 Sehenone
D507,402 S * 7/2005 Laberge ..... D2/972
D551,828 S * 10/2007 Winjum ..... D2/901
D552,834 S * 10/2007 Hannah ..... D2/946
7,328,527 B2 * 2/2008 Goldman ..... A43B 3/24 36/100
7,428,787 B2 * 9/2008 Crowley, II ..... A41D 17/005 36/1.5
7,523,567 B1 * 4/2009 McClelland ..... A43B 5/1666 36/115
7,698,834 B1 * 4/2010 Courville ..... A43B 3/24 36/100
8,109,013 B2 * 2/2012 Parrott ..... A43B 5/18 36/115
8,230,617 B2 * 7/2012 Luedecke ..... A43B 5/08 36/8.1
D680,715 S * 4/2013 Johnson, Jr. ..... D2/901
8,413,351 B1 * 4/2013 Watters ..... A43B 1/0054 36/100
8,430,829 B1 * 4/2013 Marchetti ..... A61F 15/00 602/3
8,458,927 B2 6/2013 Santos
D691,356 S * 10/2013 Whittington ..... D2/943
8,959,801 B1 * 2/2015 Siragusa, Jr. ..... A63B 71/1225 2/22
8,984,694 B2 * 3/2015 Teichert ..... A43B 3/16 12/146 R
9,314,066 B1 * 4/2016 Troconis ..... A43B 3/248
D757,404 S * 5/2016 Stevenson ..... D2/909
9,456,675 B1 * 10/2016 Haas ..... A45D 29/05
9,609,906 B2 * 4/2017 Schatz ..... A43B 5/18
2002/0053147 A1 * 5/2002 Borsoi ..... A43B 5/0401 36/54
2002/0066208 A1 * 6/2002 Hall ..... A43B 3/0078 36/7.3
2003/0089001 A1 * 5/2003 Zagami ..... A43B 3/0078 36/72 R
2003/0177664 A1 * 9/2003 Monassebian ..... A43B 1/0027 36/100
2003/0196351 A1 * 10/2003 Hipp ..... A43B 3/20 36/72 R
2004/0128862 A1 * 7/2004 Flack ..... A43C 11/008 36/100
2004/0226194 A1 * 11/2004 Schenone ..... A43B 23/24 36/112
2004/0250445 A1 * 12/2004 Pritchett ..... A43B 3/16 36/2.6
2005/0022430 A1 * 2/2005 Terry ..... A43B 1/0081 36/72 R
2005/0066543 A1 3/2005 Rosen et al.
2005/0066550 A1 * 3/2005 Liu ..... A43B 23/24 36/101
2007/0130802 A1 * 6/2007 Condie ..... A43B 1/0054 36/101
2008/0098626 A1 * 5/2008 Wright ..... A43B 3/24 36/136
2009/0265960 A1 * 10/2009 Parrott ..... A43B 5/1666 36/136
2013/0074363 A1 3/2013 Adams
2013/0081308 A1 * 4/2013 Woods ..... A43B 3/163 36/72 R
2014/0137430 A1 * 5/2014 Cherosky ..... A43B 7/12 36/7.1 R
2015/0096205 A1 * 4/2015 Yang ..... A43B 7/34 36/25 R

OTHER PUBLICATIONS

"Region" English Collins Dictionary. Web. https://www.collinsdictionary.com/us/dictionary/english/region, Aug. 2019.*

* cited by examiner

SHOE COVER SYSTEM AND METHOD OF USE

PRIORITY CLAIM

This application claims priority to U.S. Provisional Patent Application Ser. No. 61/928,322 filed on Jan. 16, 2014 and is incorporated by reference herein in its entirety.

BACKGROUND

Athletic shoes in today's age are viewed as being essential when it comes to playing an athletic sport, running, and training of any kind Running shoes are typically fashioned with flexible top surfaces and cushioned soles to minimize the impact on the foot, especially for long-distance runners. Running shoes are increasingly being made more lightweight to provide less resistance and improved performance. Lightweight shoes often include thinner sidewalls. Additionally, shoes may include mesh or holes in the outer body of the shoe, especially the top front, which helps reduce the weight of the shoe, but also further reduce the warmth and protection afforded to a foot from poor weather conditions.

Unfavorable weather impacts many facets of an outdoor activity or training Protective covers have been designed for use during the performance of an activity. Such covers, however, do not afford a quick, easy mechanism for putting on or taking off the covers. Without a quick and easy way to put on or take off such covers, they are not optimally suited for wear by athletes during the sporting activity. At best, the covers could be used when exiting a game, but the ability to quickly remove the cover prior to physical activity is difficult. Moreover, wearing a protective covering prior to activity does not provide the athletic shoe warmth to a foot and improve a user's performance. Additionally, once the overshoe is removed most athletic shoes are not water-proof and athletes that participate in outdoor activities often have to endure wet, cold feet during times of inclement weather.

Other removable accessories for footwear are known in the prior art. One example is found in US Patent Application 2013/0074363 which describes a cover to protect footwear from staining or fouling carpet or interior floors. However, these covers are meant to cover the entire bottom of the shoe, which is not applicable to athletic or training shoes.

Another example of a detachable footwear accessory is shown in US Patent Application No. 2005/0066543 which describes a shoe cover with an upper portion and a sole connected to the upper portion. The upper portion includes at least one, self-supporting and resilient shoe admission portion connected to the sole. The shoe admission portion has an inwardly inclined lead-in surface extending toward the sole, and an overhang surface extending from the lead-in surface toward the sole portion. The overhang surface is adapted to form an undercut area so that a shoe to be held to the shoe cover first engages and slides along the inclined lead-in surface to resiliently expand the admission portion outwardly without being crushed, and then slides into engagement with the overhang surface to enter the undercut area. A length adjusting mechanism may be provided for adjusting the length of the sole.

Another example, U.S. Pat. No. 8,458,927 to Santos describes bowling shoes with interchangeable foreparts and heels varying traction of the shoe sole on a surface of a bowling lane. The '927 patent describes shoe parts that can alter the stopping and the sliding characteristics of a shoe to allow a bowler with the ability to stop his/her feet suddenly and abruptly. For example, when the bowler approaches a foul line to throw a ball, one foot usually performs the slide action and the other foot performs the traction action. A slide shoe for the slide action usually has a sole made with a low friction material, and a traction shoe has a sole with a high friction material for better traction. However, a specific design of the bowling shoe will greatly depend on each bowler's individual style and preference.

Other known shoe that has interchangeable inserts and may be attached to either a left or right shoe outsole is described in U.S. Pat. No. 3,672,077, issued to Coles. Cole discloses a shoe which has removable cleats or inserts attached to a plurality of spaced recesses in the shoe sole. The user may selectively replace individual inserts that have different coefficients of friction to achieve desired degrees of traction on the bowling surface. U.S. Pat. No. 6,662,476 to Lind, U.S. Pat. No. 6,651,360 to Lind, and U.S. Pat. No. 6,243,973 to Lind all appear to relate to a pad that is interchangeable with another pad, where each pad is removably attached to either the left or right shoe. However, similar sole covers or inserts cover a portion of the overall bottom surface of the shoe sole, which negatively affects the athlete's movement.

In order to overcome these deficiencies in prior art products, runners often use duct tape to cover their ties and mesh toe area, which peels off quickly in wet or snowy conditions. Additionally, external extremities, such as toes will still endure the cold and wet conditions. Furthermore, the use of duct tape requires a runner to cover a portion of the bottom of the shoe, thereby reducing traction on the front portion a person's shoe, especially around the toe region.

There is a need in the industry for a cover for athletic shoes, namely running shoes which provide protection from the elements such as rain, sleet, snow and cold temperatures. The cover should be non-obtrusive, not detract from the aesthetics of the underlying shoe chosen by the wearer, while also being durable and inexpensive to manufacture. The cover should also not reduce the overall performance of the sole. The covers are lightweight, tuck easily into a small pocket, and quickly removable for ease of use. The invention described herein fulfills these unmet needs.

DETAILED DESCRIPTION

A cover for athletic shoes, namely running shoes which provide protection from the elements such as rain, sleet, snow and cold temperatures. The cover should be non-obtrusive, not substantially detract from the aesthetics of the underlying shoe chosen by the wearer, while also being durable and inexpensive to manufacture. The cover should also not reduce the overall performance of the sole. The covers are lightweight, tuck easily into a small pocket, and quickly removable for ease of use.

Figure 1:
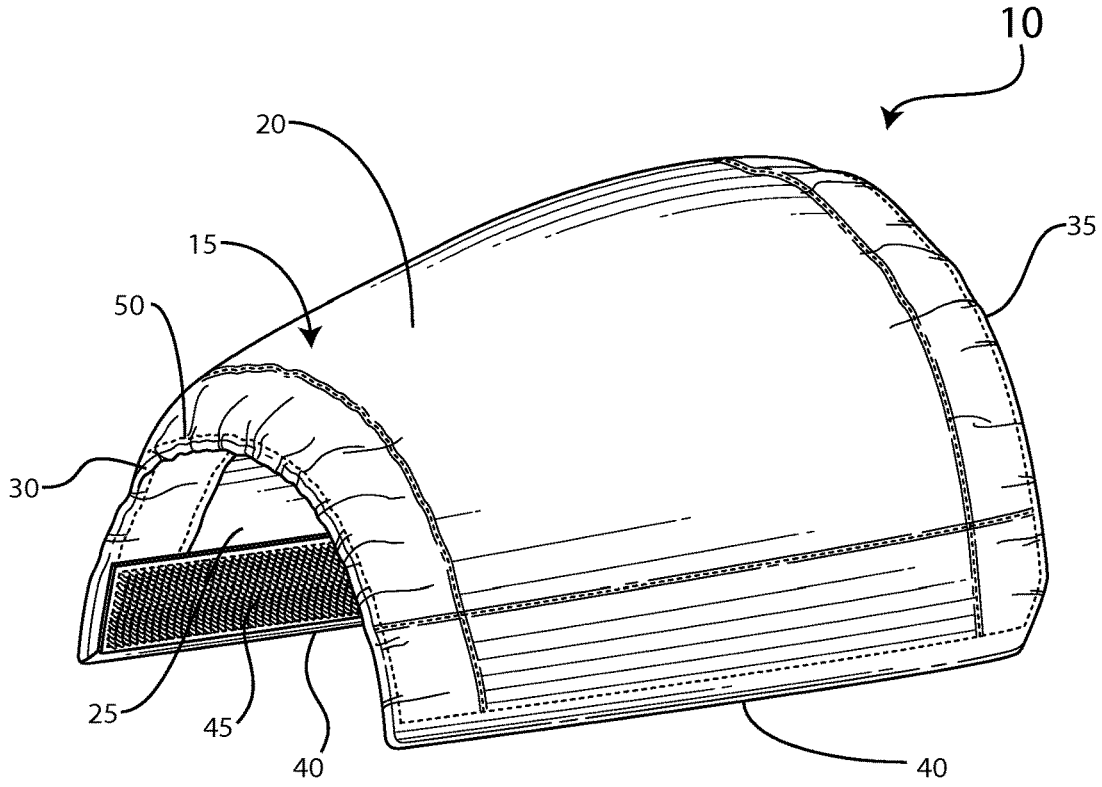
FIG. 1 is a top perspective view of the shoe cover.
Figure 2:
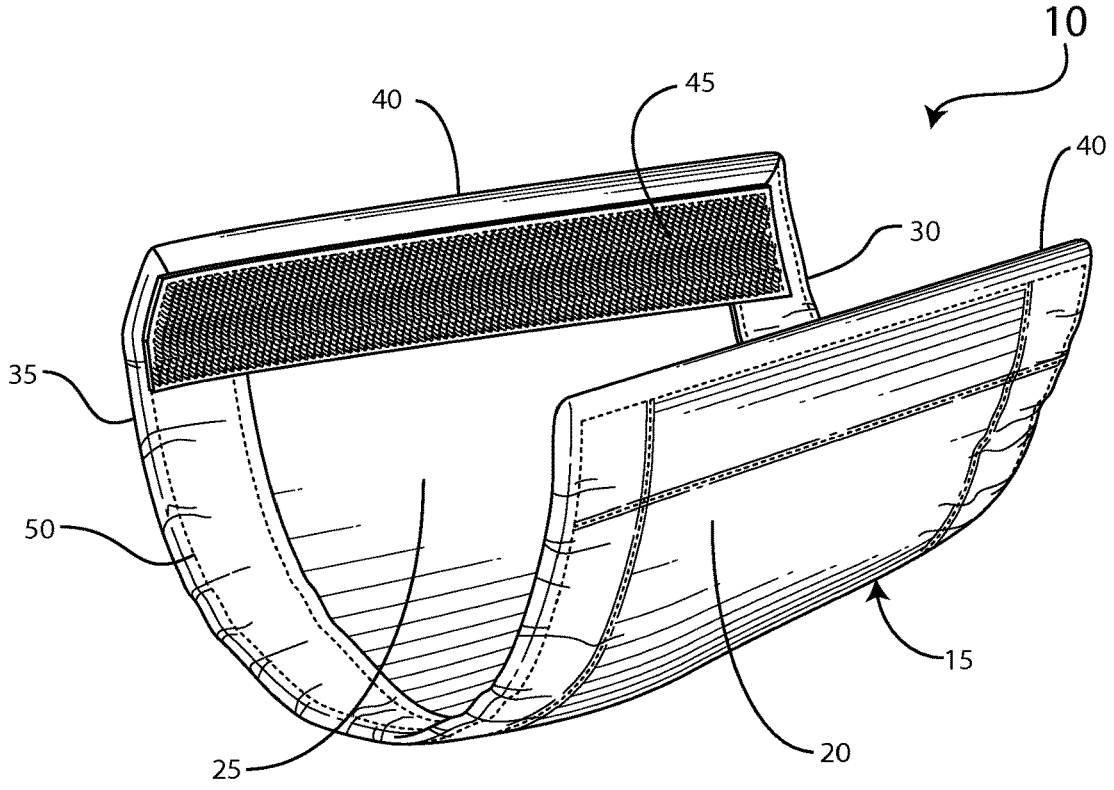
FIG. 2 is a bottom perspective view of the shoe cover.
Figure 3:
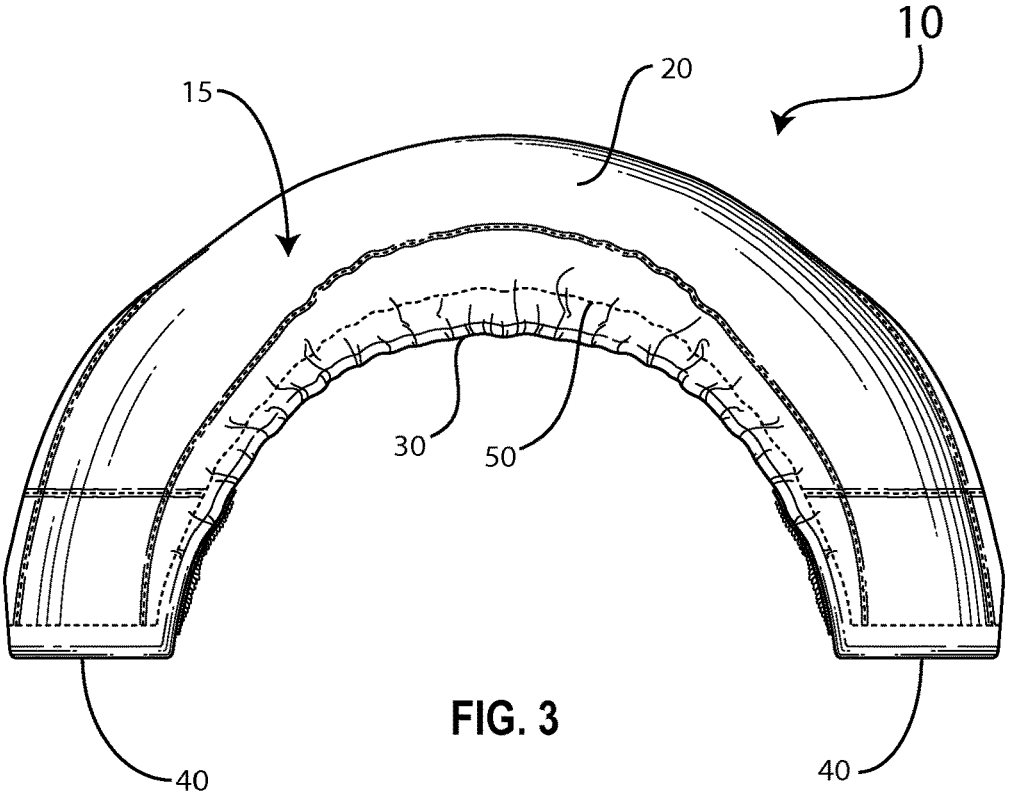
FIG. 3 is a front elevation view of the shoe cover.
Figure 4:
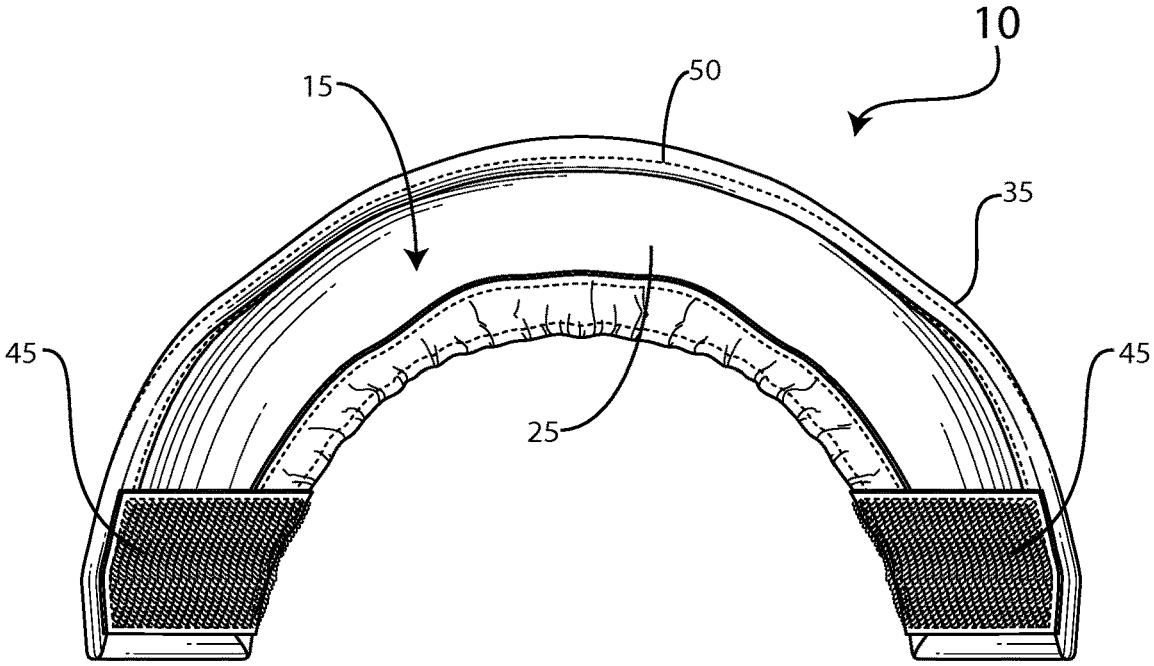
FIG. 4 is a back elevation view of the shoe cover.
Figure 5:
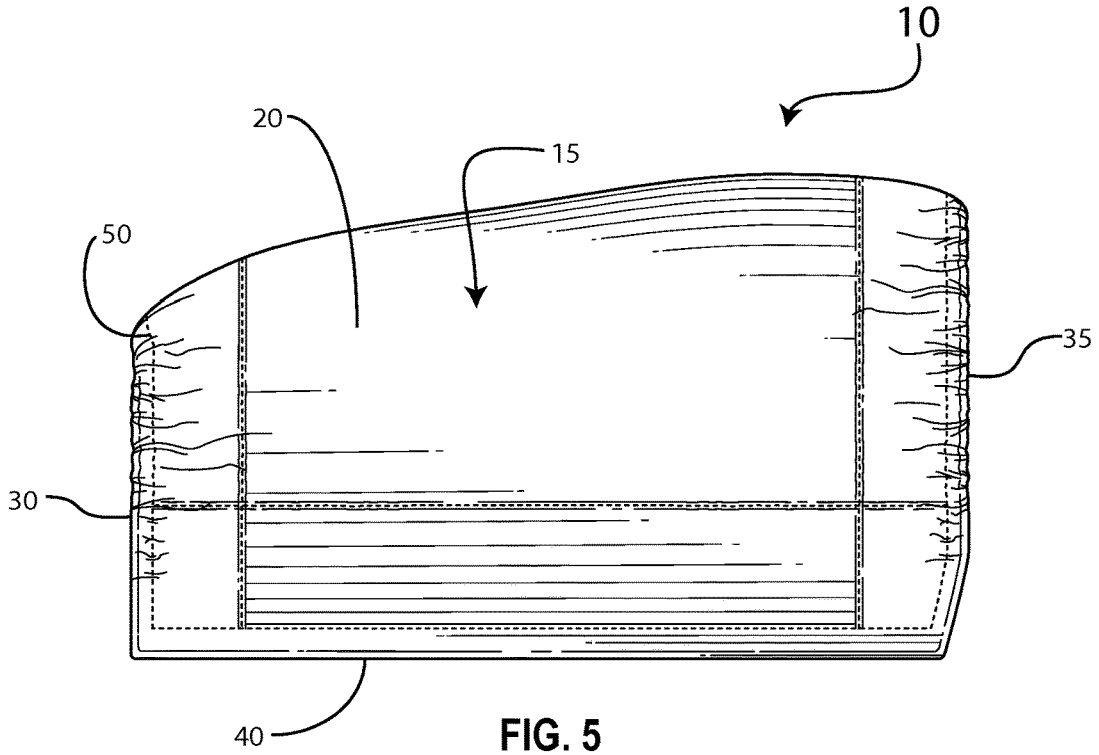
FIG. 5 is a left side elevation view of the shoe cover.
Figure 6:
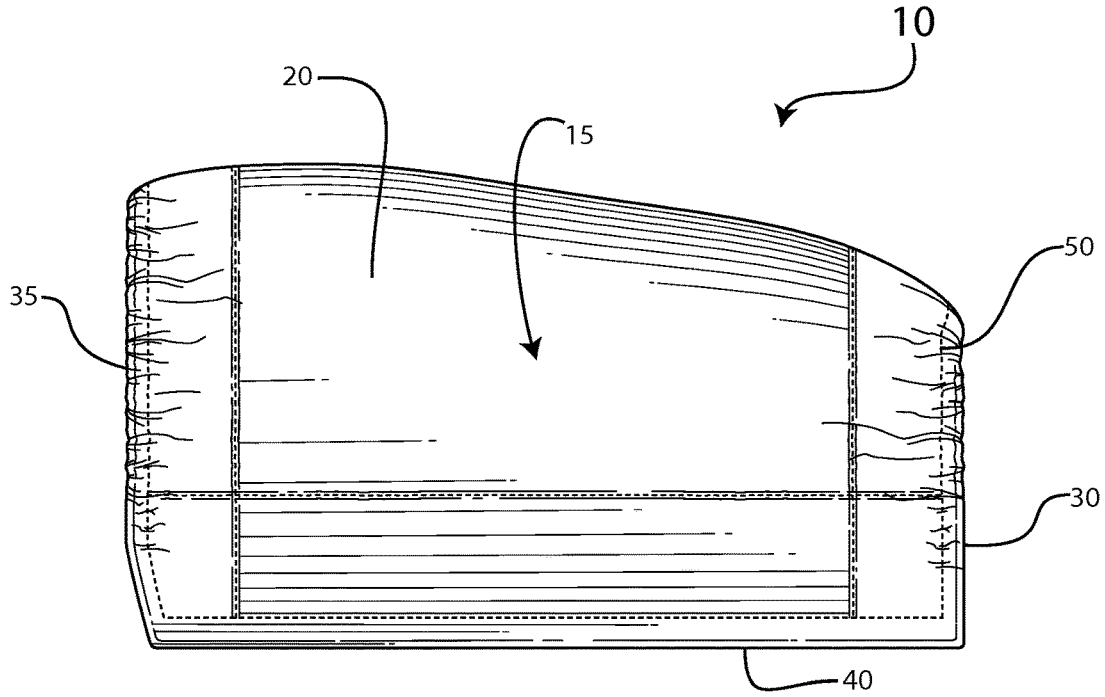
FIG. 6 is a right side elevation view of the shoe cover.

Referring now to the drawings where like reference numerals designate similar parts throughout the several views, FIGS. 1, 2 and 10 describe a shoe cover 10 which generally comprises a body 15 covering a substantial portion of the top of a shoe, namely the top front and toe region. The body 15 comprises a top surface 20 and a bottom surface 25 which join at a front edge 30, back edge 35 and side edges 40.

Figure 10A:
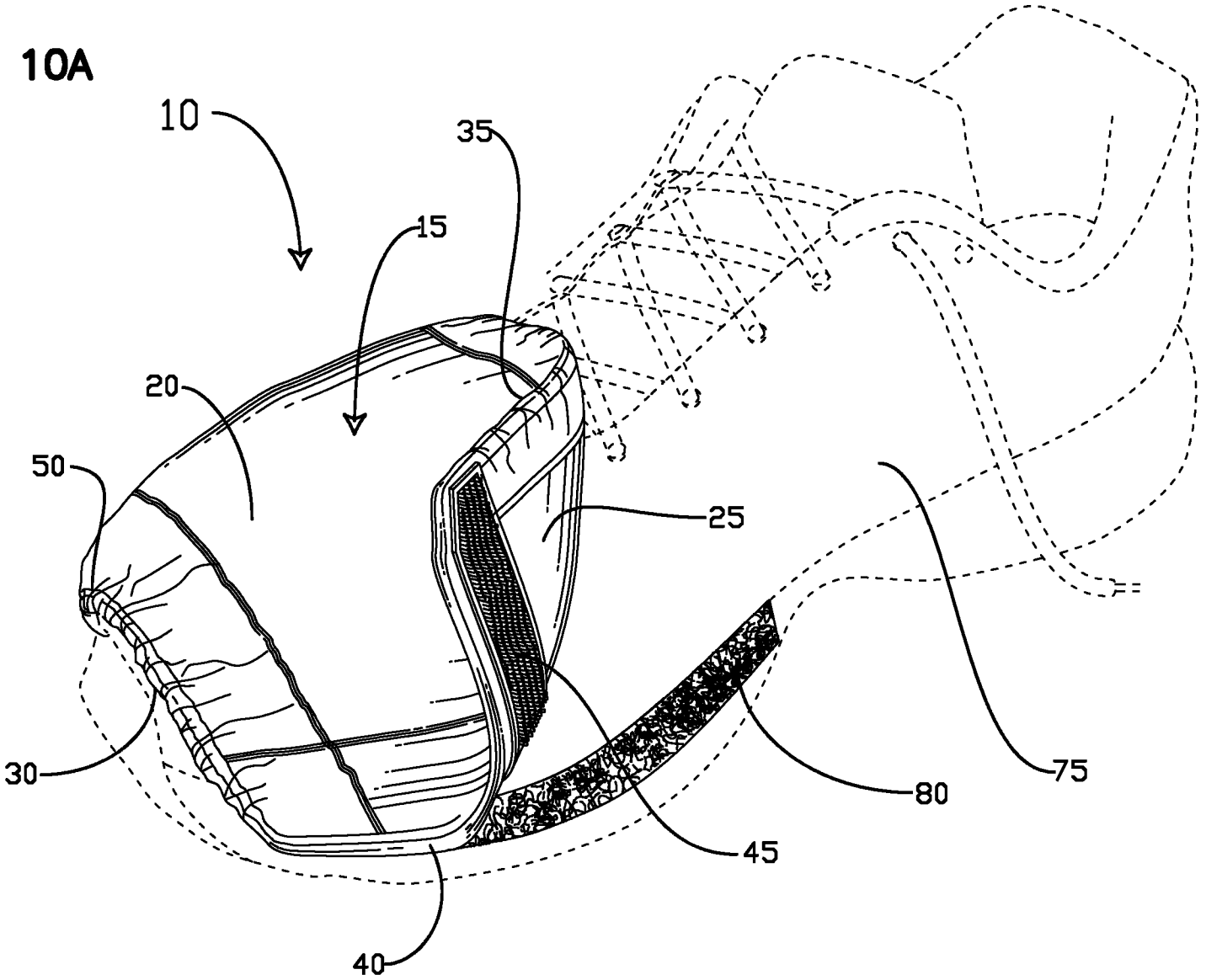
FIG. 10A is a top elevation view of the shoe cover and attachment mechanism connected to a shoe.
Figure 10B:
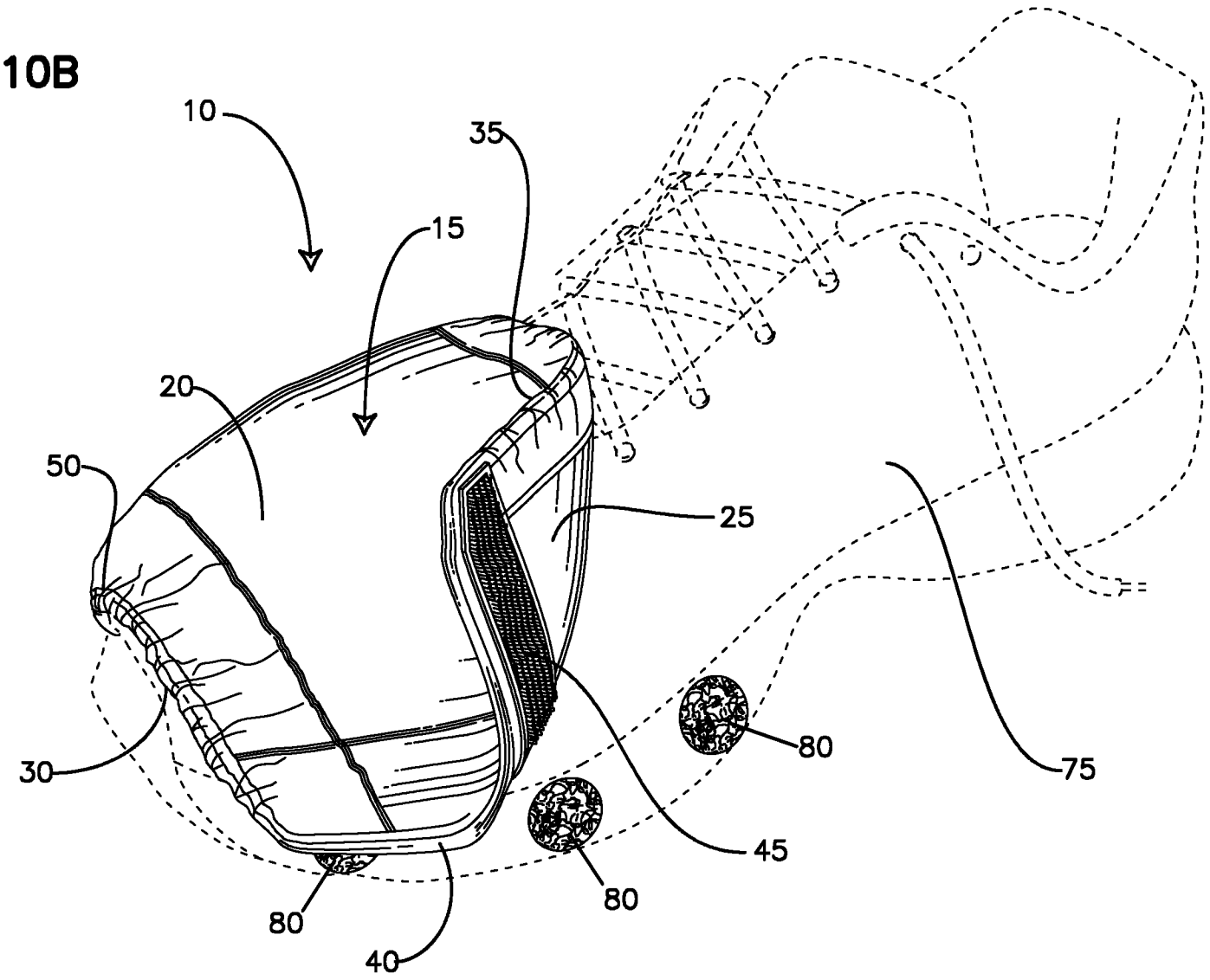
FIG. 10B is a top elevation view of the shoe cover and an alternative embodiment of second attachment mechanism connected to a shoe.

As shown, the bottom surface 25 may also include a first attachment mechanism 45 positioned adjacent side edges 40. As best shown in FIGS. 10A and 10B, first attachment mechanism 45 is shown partially connected to a second attachment mechanism 80. As shown, second attachment mechanism 80 is coupled to the side of a shoe surface around the junction between the sole and the body of an athletic shoe 75. These attachment mechanism allow for quick application and removal of shoe cover 10.

Referring now to FIGS. 1-8, which depict body 15 comprising a water-resistant material. The type of material selected should be such that moisture, wind and cold air are significantly reduced from entering the top portion of shoe 75 when shoe cover 10 is in use. Body 15 can be formed of any water-resistant material such as, for example, rubber, silicone, plastic, Gore-Tex®, polyvinyl chloride, polyurethane, silicone elastomer, fluoropolymers, wax the like and combinations thereof. In some exemplary embodiments, the material used to form the protective overshoes contains thermal insulation, such as for example Thinsulate® and polyester fibers, although other materials that provide insulation may alternatively be used, such as a flannel, other woven fabrics, or non-woven fabrics.

In related embodiments, body 15 may be formed of any desired material, such as, for example, fiber composites, cloth wrapped foam, plastic or rubberized material. In the exemplary embodiments body 15 may include one or more pockets (not shown) for accepting a heating device, such as, disposable warming packets that heat up on demand and last a particular length of time.

In some embodiments, body 15 includes a portion that extends beyond the front region of the shoe and may cover side walls (not shown) or shoe 75. Various sizes and shapes of shoe cover 10 are contemplated. Sizes such as small, medium, large and x-large that conform to various ranges of shoe size may be used, similar to athletic socks.

In alternative embodiments, shoe cover 10 is sized so that a majority of athletic shoes could utilize a single size. Accordingly, the body is able to be sized to fit around any size shoe, while still providing a snug, tight fit over the top front toe region to prevent unwanted elements from entering the shoe.

Figure 7:
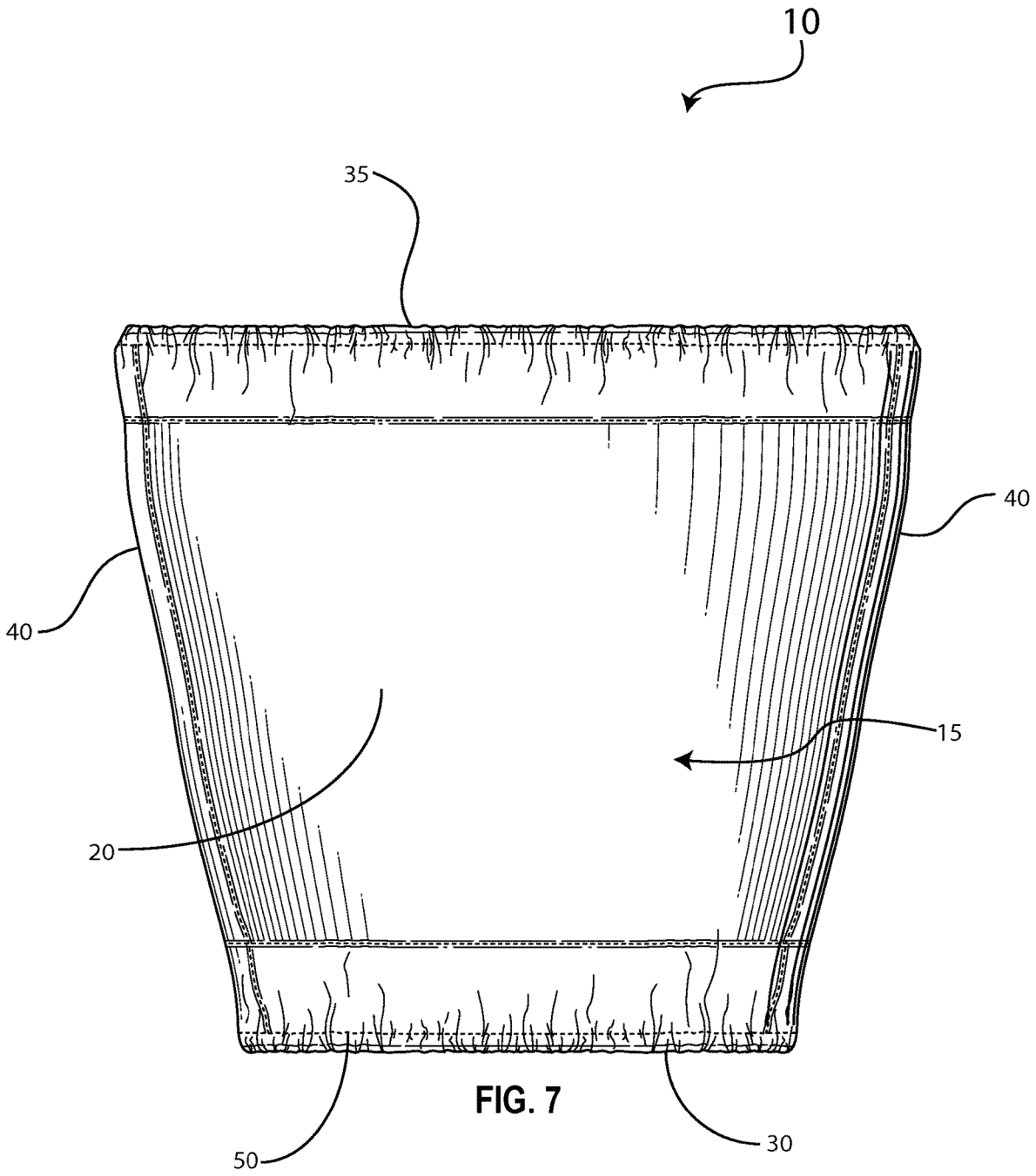
FIG. 7 is a top plan view of the shoe cover.
Figure 8:
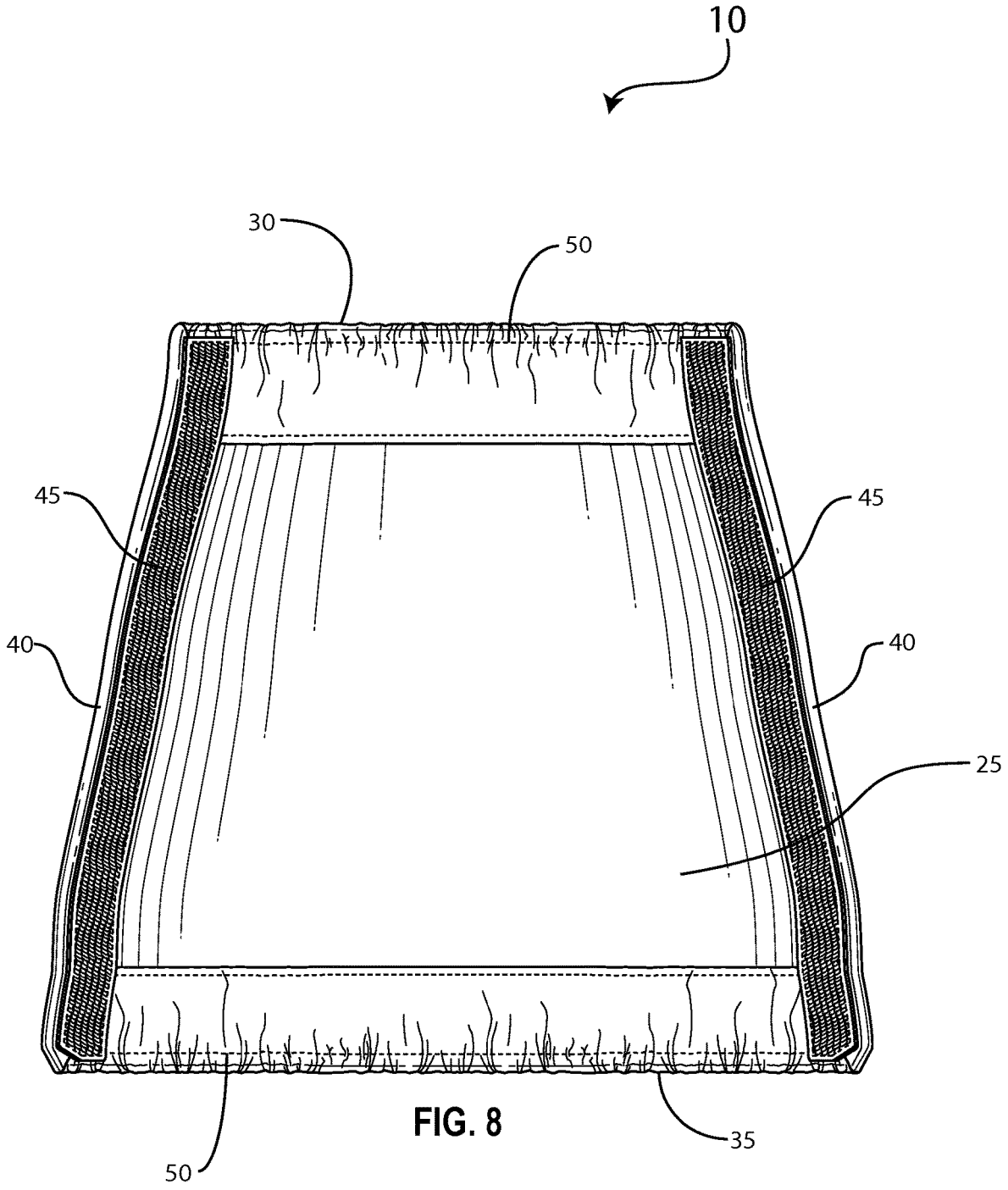
FIG. 8 is bottom plan view of the shoe cover.

Still referring to FIGS. 1-8, and best shown in FIGS. 7 and 8, the front edge 30 of shoe cover 10 is shown being shorter in length than back edge 35. This configuration allows for shoe cover to conform to the athletic shoe and provide a more true fit along the upper surface of shoe. Additionally, shoe cover 10 may also include an elastic strip adjacent the front edge 30 and back edge 35 to further enhance continuity between shoe 75 and shoe cover 10. The elastic strip may be sewn into an internal pocket formed by stitch line 50.

Still referring to FIGS. 1-8, and specifically to FIGS. 1, 2, 4, 8 and 10A-B the first attachment mechanism 45 is located adjacent the side edge 40. This configuration will allow for a secure fit along the top portion of shoe 75 and keep a foot dry and warm. Similarly, shoe cover 10 will also keep water, mud, snow, sleet, and the like out of athletic shoe 75. It should be appreciated that the use of first attachment mechanism 45 along the side edges 40 will allow shoe cover 10 to move in a manner that will not encumber the athlete while running, but fit snugly enough about the shoe 75 to prevent a substantial amount of the aforementioned elements from entering the toe region of the shoe.

Figure 9A:
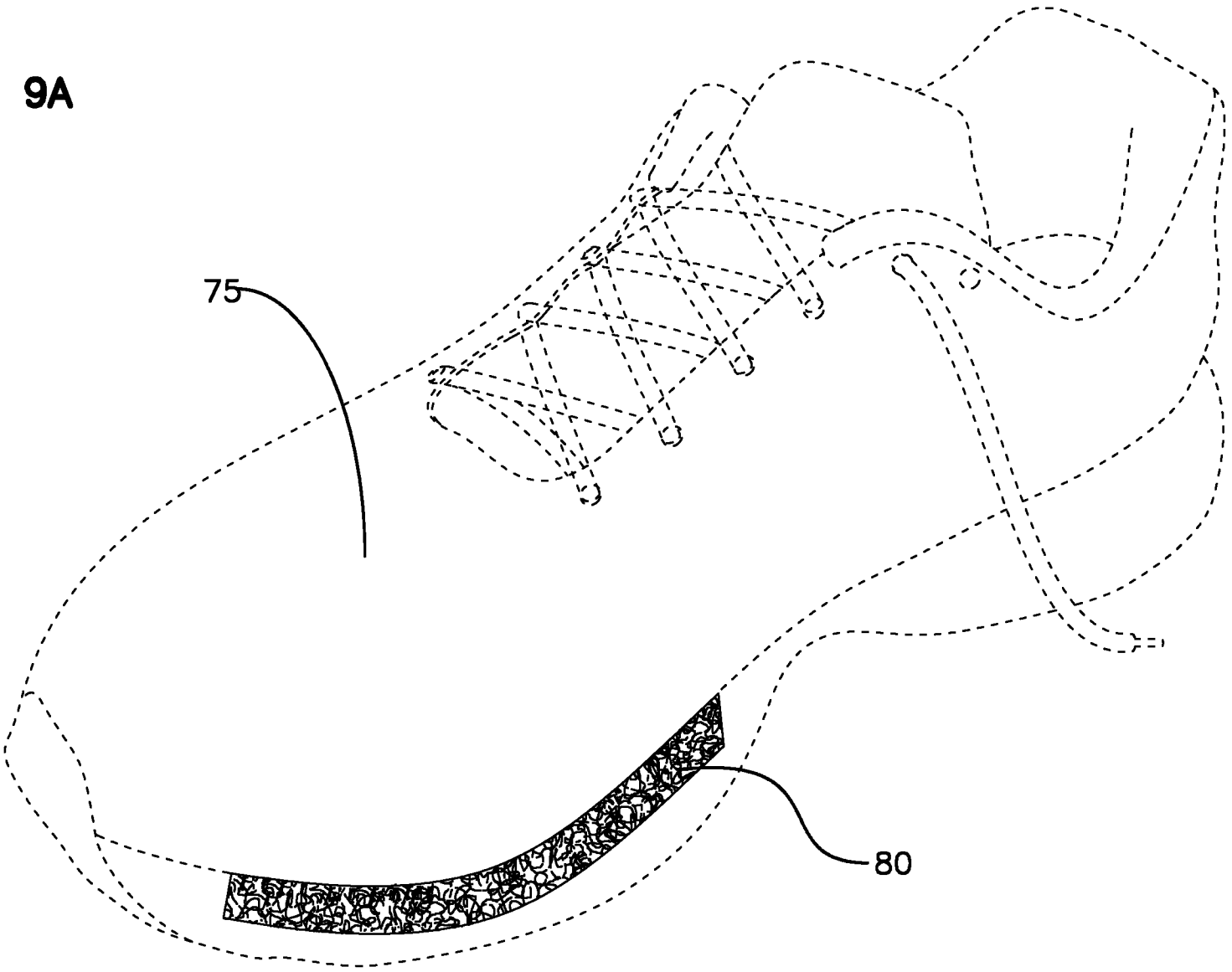
FIG. 9A is a top elevation view of the attachment mechanism connected to a shoe.

In some example embodiments, first attachment means 45 and second attachment means 80 include a zipper, Velcro®, bungee cords, laces, buttons, snaps, elastic bands or other means that can readily attach shoe cover 10 to shoe 75. It should be appreciated that the first attachment means 45 is configured to be received by second attachment means 80, or second attachment means 80 is configured to be received by first attachment means 45. Referring to FIGS. 9 and 10, second attachment means 80 may extend along a substantial portion of the side front region of shoe 75. This length may be similar to that of the first attachment means 45 coupled to shoe cover 10 to ensure a snug fit when shoe cover 10 is securedly attached to shoe 75.

Figure 9B:
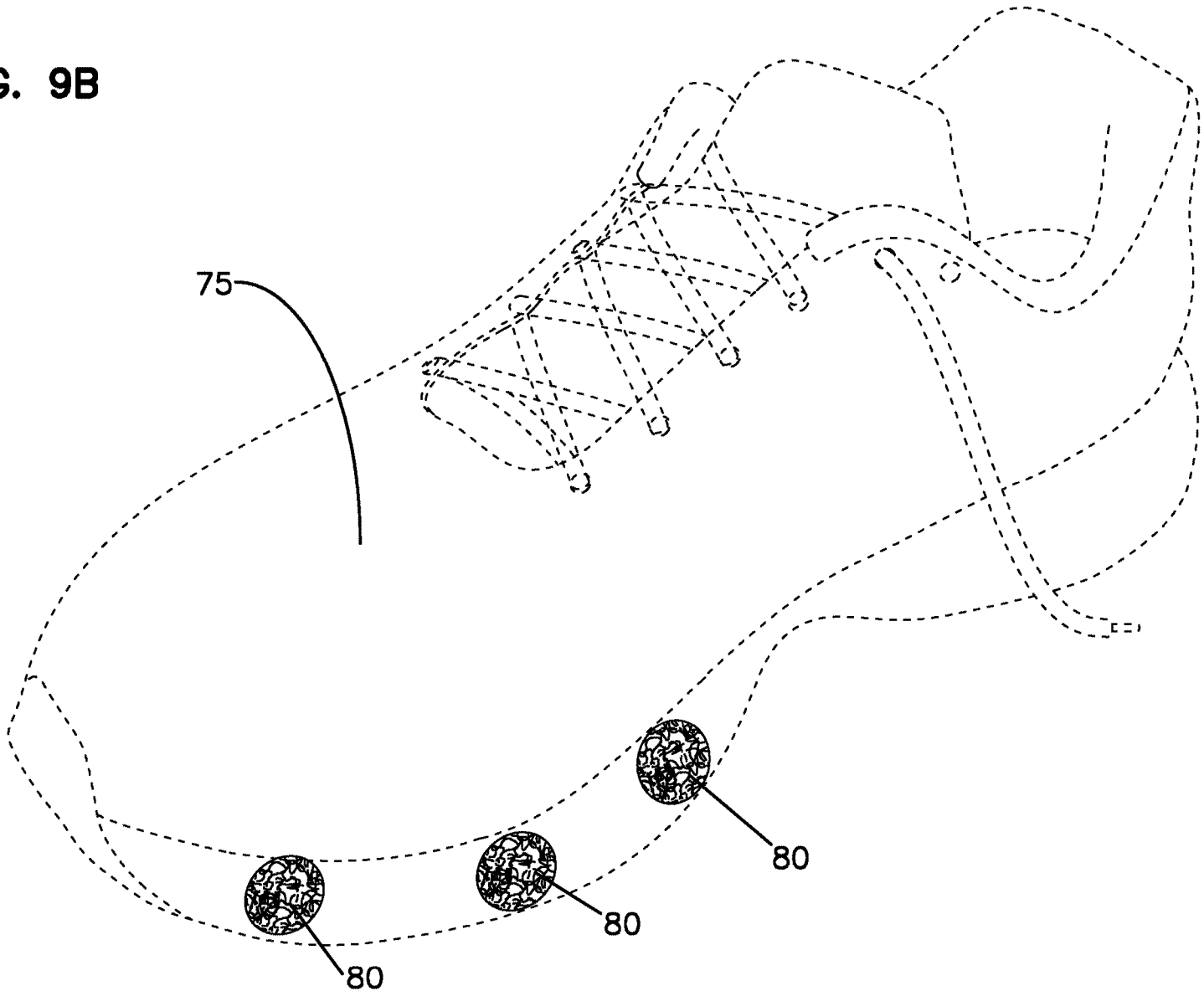
FIG. 9B is a top elevation view of an alternative embodiment of second attachment mechanism connected to a shoe.

In other example embodiments, as illustrated in FIGS. 9B and 10B, second attachment mean 80 will be shaped segments positioned along the body of shoe and sole junction. In this example embodiment, the segments may be shaped like circles (shown), squares (not shown) and the like. The segments may be positioned along a length similar to the length of first attachment mechanism 45.

As will be apparent by the skilled artisan, shoe cover 10 may be made and used in a variety of different manners. In one example embodiment, a fabric is cut out to a desire shape and size. The sizing and cutting process can occur manually or be performed by known industrial applications such as a fabric press. Once the fabric is sized and cut, the elastic bands are sewn towards the front edge 30 and back edge 35 of shoe cover 10. Moreover, first attachment mechanism 45 is sewn on the bottom surface 25 adjacent the side edges 40.

Once the shoe cover 10 is formed, a second attachment means 80 is fastened to the shoe. As mentioned above, second attachment means 80 may comprise an adhesive VELCRO® strip. Once second attachment means 80 is secured to shoe 75, a person may place shoe cover 10 upon the front portion of shoe and secure shoe cover 10.

In some example embodiments, a pair of first attachment mechanism 45 and a pair of second attachment mechanism 80 can be utilize and positioned on opposing sides of the shoe cover 10 and shoe 75 respectively. In at least this example embodiment, shoe cover 10 is secured on opposing left and right sides of shoe 75, which will provide a securely attached shoe cover 10 when in use. It should be appreciated that pair of first and pair of second attachment mechanism could be the same type of fastening element for the left and right side of shoe. Alternatively, a plurality of first attachment mechanism and a plurality of second attachment mechanism could be used where at least one of the plurality of first attachment means could be different from at least one other first attachment mechanism. Similarly, at least one of the plurality of second attachment mechanism could be different from at least one of the other second attachment mechanism. In at least this alternative embodiment the various combinations of attachment mechanism could be used to optimize shoe cover performance for a particular use. As stated above, second attachment mechanism 80 can be shaped segments (FIGS. 9B and 10B) positioned along the body of shoe and sole junction. In this example embodiment, the segments may be shaped like circles, triangles (not shown), squares (not shown), rectangles (not shown), ovals (not shown) and combinations thereof. The segments may be positioned along a length similar to the length of first attachment mechanism 45.

The general inventive concepts relate to a shoe cover for use on an athletic shoe, in particular a running shoe. However, it should be appreciated that shoe cover 10 may also be used on a number of other athletic shoes with modification that would be understood by one of ordinary skill in the art. For example, shoe cover 10 may be used as a covering for athletic shoes, such as soccer cleats, baseball spikes, cross country spikes, track spikes and other athletic shoes associated with outdoor play that may include cold, damp and/or wet conditions. Shoe cover 10 may also be used on trail boots or hiking footwear.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. The general inventive concepts are not otherwise limited, except for the recitation of the claims set forth below.

Accordingly, the scope of the present disclosure is intended to be interpreted broadly and to include all variations and modifications coming within the scope and spirit of the appended claims and their legal equivalents.

The invention claimed is:

1. A shoe cover comprising: a body defined by a top surface and a bottom surface joining at a front edge, a back edge, and side edges; a first attachment mechanism connected to the body, and a second attachment mechanism, wherein the second attachment mechanism is configured to removably connect to a side surface of a shoe between a sole and an upper surface of the shoe, and wherein the first attachment mechanism is configured to removably attach to the second attachment mechanism and wherein the front edge and the back edge comprise a substantially parallel arcuate presentation and wherein the shoe cover is adapted to be positioned on the upper surface at a toe region of the shoe and secured on opposing sides of the shoe, wherein the shoe cover is free from contact with a bottom most surface of the shoe.

2. The shoe cover of claim 1 wherein the body comprises a material selected from a group consisting of rubber, silicone, plastic, polyvinyl chloride, polyurethane, silicone elastomer, fluoropolymers, wax and combinations thereof.

3. The shoe cover of claim 1 wherein the shoe cover comprises at least two of the first attachment mechanisms adapted to connect to at least two of the second attachment mechanisms wherein a second, first attachment mechanisms is configured to removably attach to a second, second attachment mechanism, and wherein the at least two second attachment mechanisms are configured to removably connect to the shoe.

4. The shoe cover of claim 3 wherein the at least two second attachment mechanisms are configured to be removably disposed on the shoe.

5. The shoe cover of claim 3 wherein each of the at least two second attachment mechanisms are at least two separate segments spatially separated to a length similar to a length of each of the at least two first attachment mechanisms.

6. The shoe cover of claim 5 wherein said at least two second attachment mechanisms are configured in shapes selected from a group consisting of circles, triangles, squares, rectangles, ovals and combinations thereof.

7. The shoe cover of claim 1 wherein the first attachment mechanism is selected from a group consisting of a zipper, hook-and-loop fasteners, hook-and-pile fasteners, touch fasteners, cords, laces, buttons, snaps, elastic bands and combinations thereof.

8. The shoe cover of claim 1 wherein the front edge is shorter in length than the back edge.

9. The shoe cover of claim 1 wherein the body further comprises at least one elastic band fastened adjacent to either the front edge or the back edge.

10. The shoe cover of claim 1 wherein the body further comprises a pair of elastic bands and wherein a first of the pair of elastic bands is fastened on the body adjacent the front edge and a second of the pair of elastic bands is fastened on the body adjacent the back edge.

11. The shoe cover of claim 1 wherein the body is sized to cover a majority of the upper surface of the shoe, wherein the upper surface consists of a vamp and the toe region.

12. The shoe cover of claim 1 wherein the body further comprises an insulation material.

13. The shoe cover of claim 12 wherein the insulation material is selected from a group consisting of polyester fibers, flannel, woven fabric, non-woven fabric and combinations thereof.

14. The shoe cover of claim 1 wherein the body further comprises a pocket attached thereon.

15. A kit comprising: a pair of shoe covers, each of the shoe covers comprising a body defined by a top surface and a bottom surface joining at a front edge, a back edge, side edges, and at least two first attachment mechanisms connected to the body, and at least two second attachment mechanisms each with a fastener to couple the at least two second attachment mechanisms, wherein, the at least two second attachment mechanisms are configured to removably connect to a side surface of a shoe between a sole and an upper surface of the shoe, and wherein the at least two first attachment mechanisms are configured to removably attach to the at least two second attachment mechanisms, and wherein the front edge and/or the back edge of each of the pair of shoe covers comprise a substantially parallel arcuate presentation, and wherein each of the pair of shoe covers is adapted to be positioned on a portion of the upper surface at a toe region of the shoe, and secured on opposing sides of the shoe, and wherein each of the pair of shoe covers is free from contact with a bottom most surface of the shoe.

16. The kit of claim 15 wherein the body of each of the shoe covers further comprises a pair of elastic bands and wherein a first of the pair of elastic bands is fastened on the body adjacent the front edge and a second of the pair of elastic bands is fastened on the body adjacent the back edge.

17. A shoe cover comprising: a body defined by a top surface and a bottom surface joining at a front edge, a back edge, and side edges; a first attachment mechanism connected to the body, and a second attachment mechanism, wherein, the second attachment mechanism is configured to removably connect to a side surface of a shoe between a sole and an upper surface of the shoe, and wherein the first attachment mechanism is configured to removably attach to the second attachment mechanism, and wherein the front edge and the back edge comprise a substantially parallel arcuate presentation, and wherein the shoe cover is adapted to cover a majority of the upper surface of the shoe, wherein the upper surface consists of a vamp and the toe region, and wherein the shoe cover is free from contact with a bottom most surface of the shoe.

18. A shoe cover comprising: a body defined by a top surface and a bottom surface joining at a front edge, a back edge, and side edges; a first attachment mechanism connected to the body; and a second attachment mechanism, wherein the second attachment mechanism is configured to removably connect to the side and/or front region of a shoe between a sole and an upper surface of the shoe, and wherein the first attachment mechanism is configured to removably attach to the second attachment mechanism and wherein the front edge and the back edge comprise a substantially parallel arcuate presentation and wherein the shoe cover is adapted to be positioned on the upper surface at a toe region of the shoe and secured on opposing sides of the shoe, wherein the shoe cover is free from contact with a bottom most surface of the shoe.

19. A shoe cover comprising: a body defined by a top surface and a bottom surface joining at a front edge, a back edge, and side edges, wherein the front edge is shorter in length than the back edge, a first attachment mechanism connected to the body; and a second attachment mechanism, wherein the second attachment mechanism is configured to removably connect to the side and/or front region of a shoe between a sole and an upper surface of the shoe, and wherein the first attachment mechanism is configured to removably attach to the second attachment mechanism and wherein the front edge and the back edge comprise a substantially parallel arcuate presentation and wherein the shoe cover is adapted to be positioned on the upper surface at a toe region of the shoe and secured on opposing sides of the shoe, wherein the shoe cover is free from contact with a bottom most surface of the shoe when in use.

* * * * *